United States Patent [19]

Lampinen

[11] 3,945,498

[45] Mar. 23, 1976

[54] ARTICLE SUPPORTING DEVICE

[76] Inventor: Wesley Lampinen, Ashby, Mass. 01430

[22] Filed: Sept. 30, 1974

[21] Appl. No.: 510,555

[52] U.S. Cl. ..... 211/60 R; 248/127; 248/163; 248/188.1

[51] Int. Cl.[2] ..... A47F 7/00

[58] Field of Search ..... 108/161; 248/163, 440, 248/158, 188.1, 188.8, 127; 211/60 R, 60 A, 120; 126/164, 165, 298, 336; D7/206, 207, 212; D23/96, 135

[56] References Cited

UNITED STATES PATENTS

| | | | |
|---|---|---|---|
| 1,719,708 | 7/1929 | Luber | 248/163 X |
| 2,193,527 | 3/1940 | Beatz | 248/163 X |
| 2,730,388 | 1/1956 | Roberton | 248/188.1 |
| 2,736,089 | 2/1956 | Cooper | 248/158 X |
| 3,041,031 | 6/1962 | Pearson | 248/158 |
| 3,335,990 | 8/1967 | Giacomini | 248/163 X |
| D177,234 | 3/1956 | Hudson et al. | D7/212 |

*Primary Examiner*—Roy D. Frazier
*Assistant Examiner*—Terrell P. Lewis
*Attorney, Agent, or Firm*—C. Yardley Chittick

[57] ABSTRACT

The invention comprises an article of manfacture made principally of two lengths of chain in which the lengths, arranged either circularly or semi-circularly, have had their links welded together to form a pair of diverging units connected together at their upper ends by welding either to the under side of a top plate or to other connecting elements. Legs have been welded to the bottom portions to support the unit on a floor or other under surface. The units may be utilized to hold a quantity of logs adjacent a fireplace or if of proper size might be used as magazine racks or as holders of any other kind of relatively rigid material that could be placed thereon.

3 Claims, 8 Drawing Figures

ARTICLE SUPPORTING DEVICE

BRIEF SUMMARY OF THE INVENTION

The invention which is an article of manufacture consists of lengths of conventional chain which have had their links welded together to form a pair of identical elements. These elements may be preferably semicircular or circular, but it will be understood that the invention is not limited to these configurations. The two rigid chain elements are placed together in downwardly diverging positions and the adjacent top portions are welded together. In the case of the circular construction the tops of the circular chain elements are welded to the underside of a metal plate. In the case of the semicircular construction, the upper ends are preferably connected to a pair of terminal members which may be in the form of rings or other configurations to which the chain ends can be welded. Each of the two elements, whether circular or semicircular has a pair of legs welded thereto so that the entire finished units will stand on four widely spaced legs.

The chains can be of any size according to the loads that are to be supported. The welding of the links is preferably limited to welds on the interior sides of the links where they are relatively invisible. The welds are of such strength that a man may sit on the top plate of the circular type without fear of breakage of the welds, or of the legs.

DETAILED DISCRIPTION OF A PREFERRED EMBODIMENT OF THE INVENTION

Figure 2:
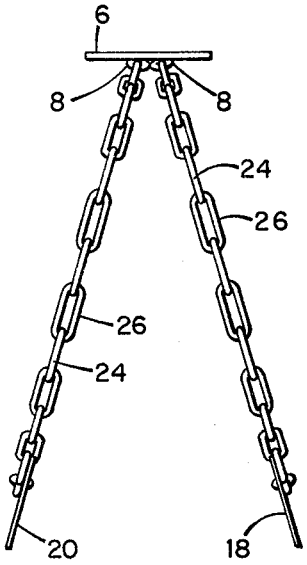
FIG. 2 is a side elevation of FIG. 1.
Figure 1:
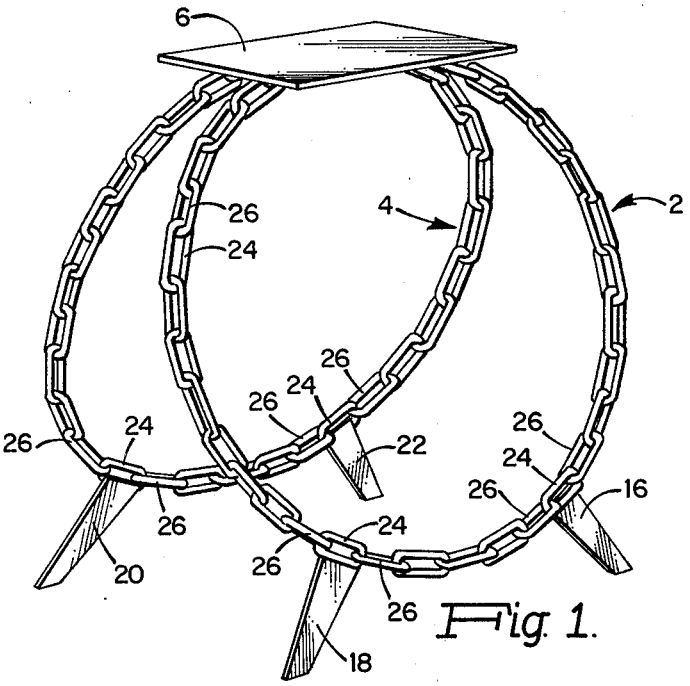
FIG. 1 is a prespective view of the circular type unit.
Figure 6:
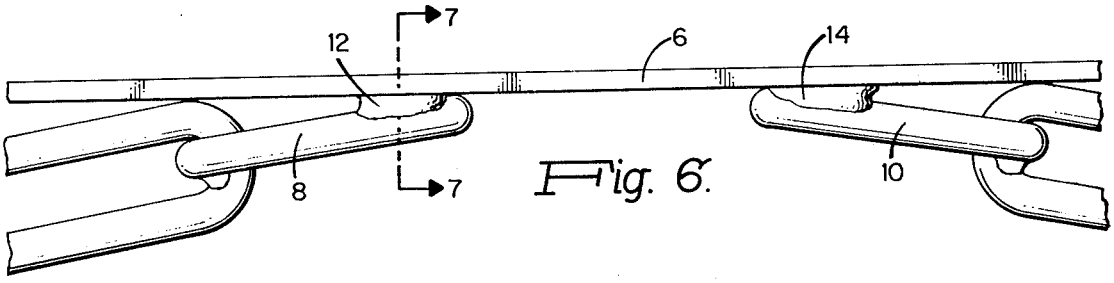
FIG. 6 is a fragmentary enlarged front elevation showing the welding of the ends of the circular chains to the underside of the top plate.

Referring to FIG. 1, it will be seen that the article of manufacture is comprised of two lengths of chain, 2 and 4, each of which has been arranged in the form of a circle and the links then welded to each other so as to produce a pair of circularly disposed chains. The upper ends of the chains, as shown in FIG. 6 preferably come relatively close together but do not touch. They rest against the underside of a top supporting plate 6, to which the end links 8 and 10 have been welded as at 12 and 14. Two legs, 16 and 18, have been welded to the lower part of chain 2 and legs 20 and 22 have been welded to the lower part of chain 4.

Figure 3:
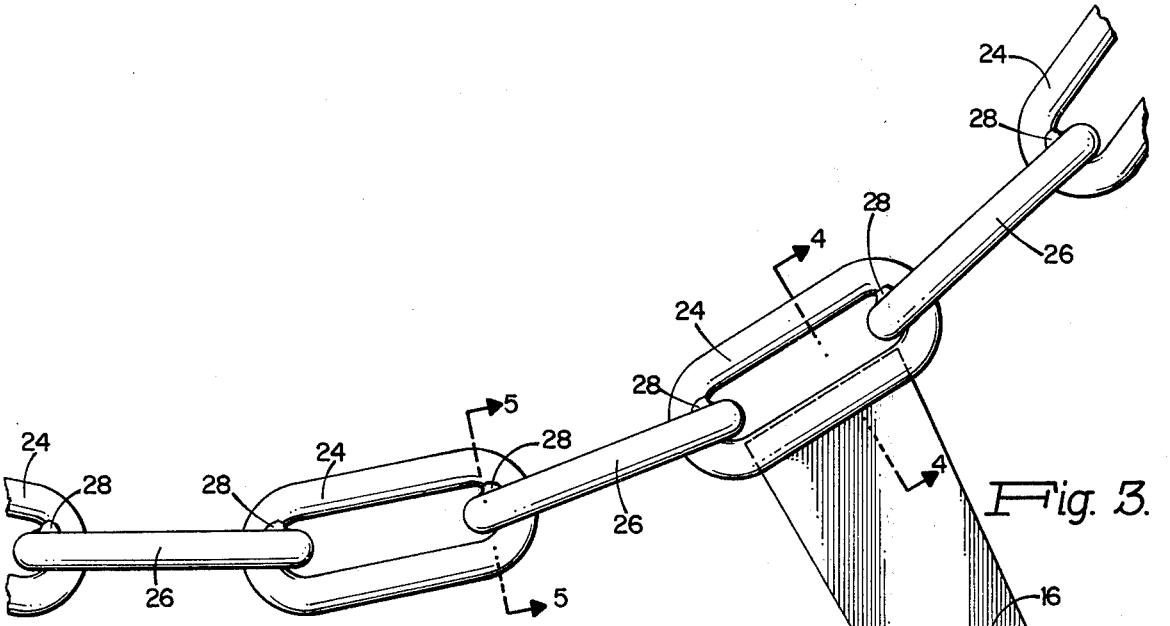
FIG. 3 is an enlarged front elevation of a portion of a chain and one leg, showing the welds on the interior sides of the areas of engagement of the links.
Figure 5:
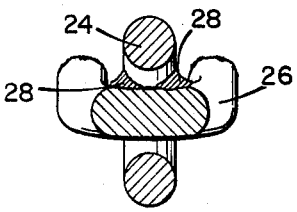
FIG. 5 is a section taken approximately on the line 5—5 of FIG. 3.
Figure 4:
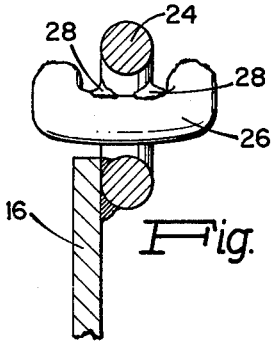
FIG. 4 is a section taken approximately on the line 4—4 of FIG. 3.

While the invention contemplates that the links may be welded to each other in any manner that will present a strong construction, in a preferred form the links will be welded on the interior side of the circle, which construction is plainly shown in FIGS. 3, 4, and 5. The links 24, which are representative of the links that lie substantially in the plane of each circular unit are at right angles to the links 26 which are representative of the remaining links. The welds indicated at 28 are shown as being on the interior side of the circular arrangement in which position they are inconspicous. It has been found by experimentation that the welds 28 connect links 24 and 26 together with such strength that when the unit is heavily loaded, the links will bend before the welds will break. Likewise, as shown in FIGS. 1, 3 and 4 it will be noted that all of the legs 16, 18, 20 and 22 have been welded to the interior sides of links 24 which effectively hides the welds from the user's view.

Figure 7:
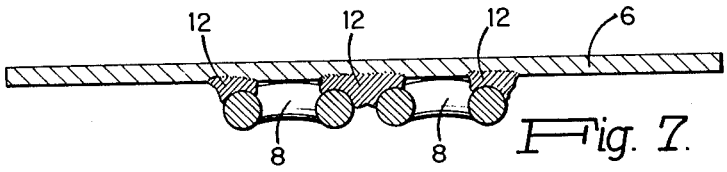
FIG. 7 is a vertical section taken approximately on the line 7—7 of FIG. 6.

The top plate 6 is preferably in the form of a sheet of steel of any suitable dimensions and thickness to support the loads that it will be called on to carry. In a preferred construction the top plate 6 may be 6× 12 inches and 3/16 or ¼ inch thick. No limitation however, is to be imposed on the dimensions of the top plate so long as it is of suitable size to receive against its underside the terminal links 8 and 10, which are welded to the underside of the plate as at 12 and 14 in FIGS. 6 and 7.

While the alternate links of the circular unit are shown as aligned, it is to be understood that the chain links could be twisted somewhat with respect to each other in order to vary the appearance without in any way diminishing the serviceability of the construction.

Figure 8:
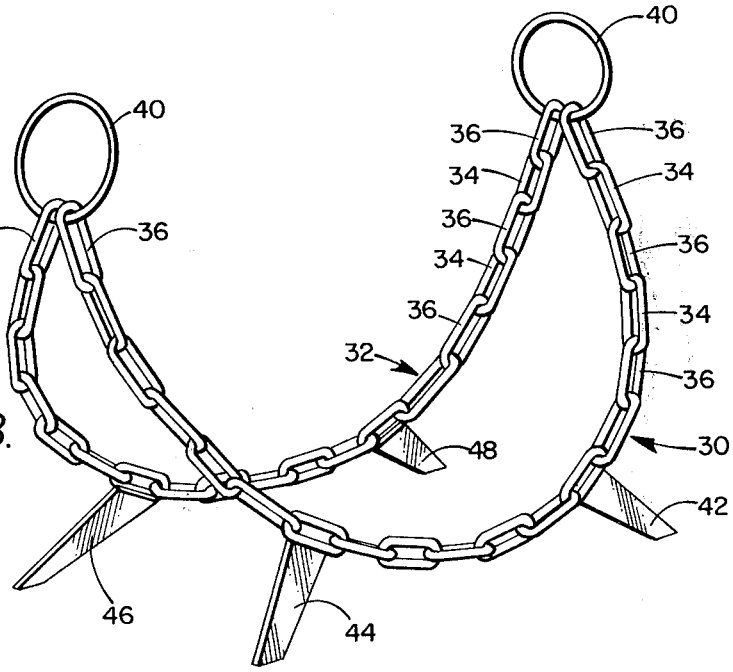
FIG. 8 is a perspective view of the semi-circular form of the article.

A modified form of the invention is shown in FIG. 8. Here the chains 30 and 32 have been shortened to form a pair of semi-circular elements comprised of links 34 and 36 welded together in the same manner as links 24 and 26 with the ends links 36 having rings 40 passing therethrough and to which the end links 36 are welded.

In this modification there are also four legs, 42, 44, 46 and 48, which will support the unit firmly on the floor.

It will be appreciated that the invention is not limited as to the exact configuration of the lengths of chain, nor in the particular manner in which the upper ends of the chain elements are connected together. The intention is to provide curved structural elements made of lengths of chain which have been rendered rigid by welding the links together. The form of the chain lengths permits two substantially identical elements to be welded together to form a useful article for supporting something such as, for example, fire place logs. The addition of the legs is essential for proper stability.

It will be understood that various changes in the details, materials and arrangement of parts which have herein been illustrated in order to explain the nature of the invention may be made by those skilled in the art within the scope of the appended claims.

I claim:

1. An article of manufacture comprising a first length of chain in which the links are arranged in a curved pattern and each link has been welded to each next adjacent link to form a first rigid curved chain element, a second length of chain in which the links are arranged in a curved pattern and each link has been welded to each next adjacent link to form a second rigid curved chain element, means rigidly connecting the said chain elements together at their upper portions to provide a pair of downwardly extending curved chain elements spaced at their lower portions, supporting means welded to the lower portions of each chain element adapted to rest on an underlying surface and to maintain said connected curved chain elements in a stable condition on said surface, each of said rigid curved chain elements extending through substantially a semi-circle, the means rigidly connecting the said chain elements together comprising a pair of rings to which said chain elements are welded.

2. The construction set forth in claim 1, said semi-circular chain elements being set at a downwardly diverging angle and said supporting means being in the form of a plurality of individual legs.

3. An article of manufacture comprising, a first length of chain in which the links are arranged in a substantially semi-circular planar pattern and each link has been welded to each next adjacent link to form a first rigid curved chain element, a second length of chain formed substantially identical to said first length of chain thereby to provide a pair of rigid curved chain elements, said first and second rigid curved chain elements being positioned with respect to each other at downwardly diverging angles from a vertical plane located therebetween, the upper ends of said first and second chain elements being welded to common connecting means in the form of rings, a plurality of supporting members welded to the intermediate portions of said chain elements, said supporting members having their lower ends lying in a common plane that does not intersect said chain elements, the aforesaid structure providing a rigid unit in which the semi-circular portions of said first and second chain elements may act as supports for articles placed there across.

* * * * *